US006488362B2

(12) United States Patent
Silverbrook

(10) Patent No.: US 6,488,362 B2
(45) **Date of Patent: *Dec. 3, 2002**

(54) INKJET PRINTHEAD WITH NOZZLE POKERS

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/966,290

(22) Filed: Sep. 28, 2001

(65) Prior Publication Data

US 2002/0039125 A1 Apr. 4, 2002

Related U.S. Application Data

(63) Continuation of application No. 09/425,416, filed on Oct. 19, 1999, now Pat. No. 6,299,289.

(30) Foreign Application Priority Data

Sep. 11, 1998 (AU) ..... PP7022

(51) Int. Cl.[7] ..... B41J 2/04; B41J 2/015

(52) U.S. Cl. ..... 347/54; 347/20

(58) Field of Search ..... 347/54, 20, 320

(56) References Cited

U.S. PATENT DOCUMENTS 6,027,205 A * 2/2000 Herbert ..... 347/54
6,299,289 B1 * 10/2001 Silverbook ..... 347/54

* cited by examiner

*Primary Examiner*—Thinh Nguyen

(57) ABSTRACT

An inkjet printhead, typically constructed by MEMS process, includes a large number of nozzle chambers each with an ink ejection nozzle aperture and a paddle moveable in each chamber by an actuator to deliver ink through the aperture. Each paddle is provided with a projecting poker, concentrically protruding through the nozzle aperture when actuated to inhibit clogging of the nozzle.

9 Claims, 5 Drawing Sheets

INKJET PRINTHEAD WITH NOZZLE POKERS

This is a Continuation of U.S. Ser. No. 09/425,416 filed on Oct. 19, 1999 now U.S. Pat. No. 6,299,289.

FIELD OF THE INVENTION

The present invention relates to the field of fluid ejection devices such as inkjet printers and, in particular, discloses the utilization of a poker on the ink ejection paddle.

BACKGROUND OF THE INVENTION

Many different types of printing have been invented, a large number of which are presently in use. The known forms of printers have a variety of methods for marking the print media with a relevant marking media. Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques of ink jet printing have been invented. For a survey of the field, reference is made to an article by J Moore, "Non-Impact Printing: Introduction and Historical Perspective", Output Hard Copy Devices, Editors R Dubeck and S Sherr, pages 207–220 (1988).

Ink Jet printers themselves come in many different types. The utilisation of a continuous stream ink in ink jet printing appears to date back to at least 1929 wherein U.S. Pat. No. 1,941,001 by Hansell discloses a simple form of continuous stream electrostatic ink jet printing.

U.S. Pat. No. 3,596,275 by Sweet also discloses a process of a continuous ink jet printing including the step wherein the ink jet stream is modulated by a high frequency electrostatic field so as to cause drop separation. This technique is still utilized by several manufacturers including Elmjet and Scitex (see also U.S. Pat. No. 3,373,437 by Sweet et al)

Piezo-electric ink jet printers are also one form of commonly utilized ink jet printing device. Piezo-electric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezo electric crystal, Stemme in U.S. Pat. No. 3,747,120 (1972) discloses a bend mode of piezo-electric operation, Howkins in U.S. Pat. No. 4,459,601 discloses a Piezo electric push mode actuation of the ink jet stream and Fischbeck in U.S. Pat. No. 4,584,590 which discloses a sheer mode type of piezoelectric transducer element.

Recently, thermal ink jet printing has become an extremely popular form of ink jet printing. The ink jet printing techniques include those disclosed by Endo et al in GB 2007162 (1979) and Vaught et al in U.S. Pat. No. 4,490,728. Both the aforementioned references disclosed ink jet printing techniques rely upon the activation of an electrothermal actuator which results in the creation of a bubble in a constricted space, such as a nozzle, which thereby causes the ejection of ink from an aperture connected to the confined space onto a relevant print media. Printing devices utilizing the electrothermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

Recently, the present applicant has disclosed for example, an Australian Provisional Patent No. PP6534 entitled "Micromechanical Device and Method (IJ46a)", filed Oct. 16, 1998 a new form of ink jet printer containing an ink ejection mechanism that includes a thermal bend actuator actuated in an external ambient environment which is interconnected with a paddle mechanism utilised for the ejection of ink.

Unfortunately, in the aforementioned ink jet printing arrangement as in most ink jet printing arrangements, there is a tendency of the ink ejection nozzles to dry out over time which can result in the build up of encrustaceans etc. Further, there is also the propensity of such devices to become clogged by other means such as foreign bodies in the ink or paper fibres, material etc. around the ink ejection nozzle.

Further, in the aforementioned arrangement, there is a significant gap left in one wall of the ink ejection chamber, the gap being required and utilized by the movement of the thermal actuator up and down during an ejection cycle. Unfortunately, the provision of the slot may cause ink flow to wick out of the nozzle chamber and along the thermal actuator which can cause problems with ink loss due to wicking. Such ink loss is generally undesirable.

SUMMARY OF THE INVENTION

There is disclosed herein an inkjet printhead having a plurality of nozzle devices each comprising:

- an ink chamber having an ink ejection aperture,
- a paddle situated within the chamber,
- an actuator connected to the paddle so as to move the paddle toward the aperture,
- a projection extending from the paddle and configured to extend through the aperture when the paddle is moved by the actuator toward the aperture to eject a drop of ink from the chamber through the aperture.

Preferably the ink chamber of each nozzle device is supplied with ink via at least one conduit in an underlying substrate.

Preferably the projection is an elongate poker member, a free end of which is positioned to protrude at least into the aperture when the paddle is moved by the actuator toward the aperture to eject a drop of ink from the chamber.

Preferably the projection of each nozzle device is located concentrically with the aperture.

Preferably the aperture is formed by MEMS process in which a series of layers are deposited and etched and the projection comprises a hollow cylindrical column.

Preferably the hollow cylindrical column includes a proximal end at the paddle and a distal end adjacent the aperture, said distal end being chemically mechanically planarized during formation of the aperture.

Preferably the actuator is a thermal bend actuator conductively heated so as to cause movement of said paddle.

Preferably the projection is located substantially centrally on the paddle.

There is further disclosed herein an inkjet printhead having a plurality of nozzle devices, each including an ink chamber having an ink ejection aperture, a paddle situated within the chamber and an actuator connected to the paddle so as to move the paddle toward the aperture, a method of improving operational characteristics of the printhead comprising the step of:

locating a projection on the paddle configured to extend through the aperture when the paddle is moved by the actuator toward the aperture to eject a drop of ink from the chamber through the aperture.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED EMBODIMENTS

In the preferred embodiment, a paddle is formed with a "poker" device attached in a central portion thereof such that, during movement of the paddle, the poker device pokes any unwanted foreign body or material which should congregate around the nozzle, out of the nozzle. The poker can be formed during fabrication of the ink ejection nozzle arrangement by means of a chemical mechanical planarization step with, preferably, the formation being a byproduct of the normal formation steps for forming the ink ejection nozzle on arrangement on a semi-conductor wafer utilizing standard MEMS processing techniques.

Additionally, in order to restrict the amount of wicking and the opportunities for wicking, an actuator slot guard is provided, formed on the bend actuator itself, closely adjacent to the actuator slot so as to restrict the opportunities for flow of fluid out of the nozzle chamber due to surface tension effects.

Figure 1:
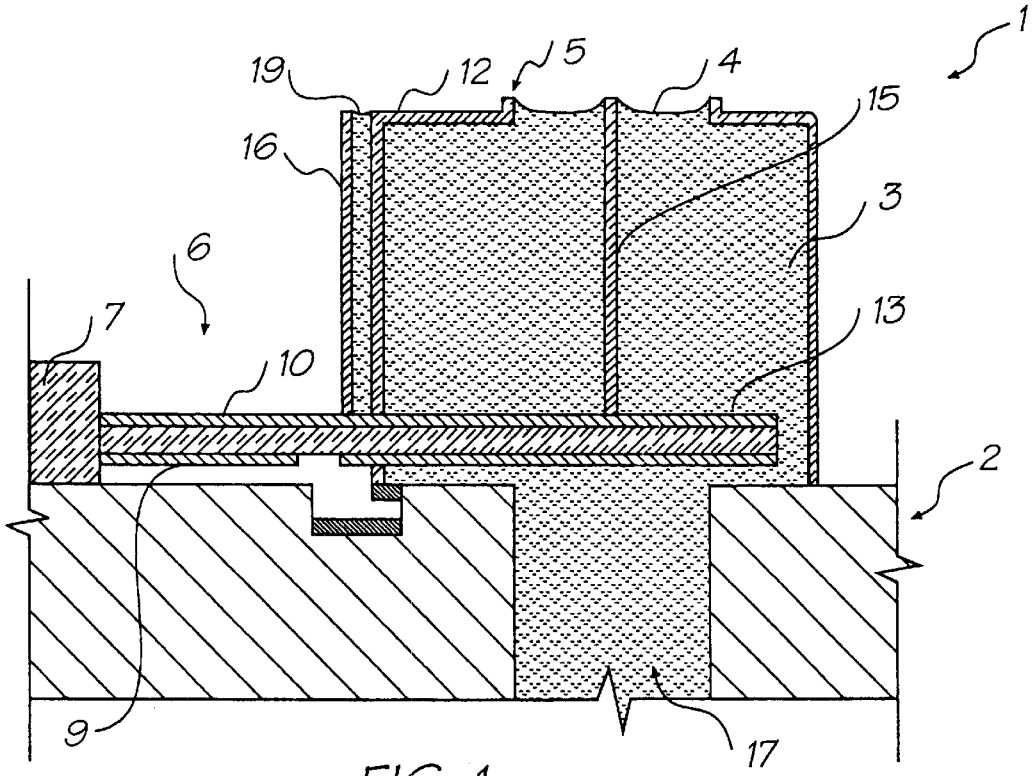
FIGS. 1–3 illustrates schematically the operational principles of the preferred embodiments.
Figure 2:
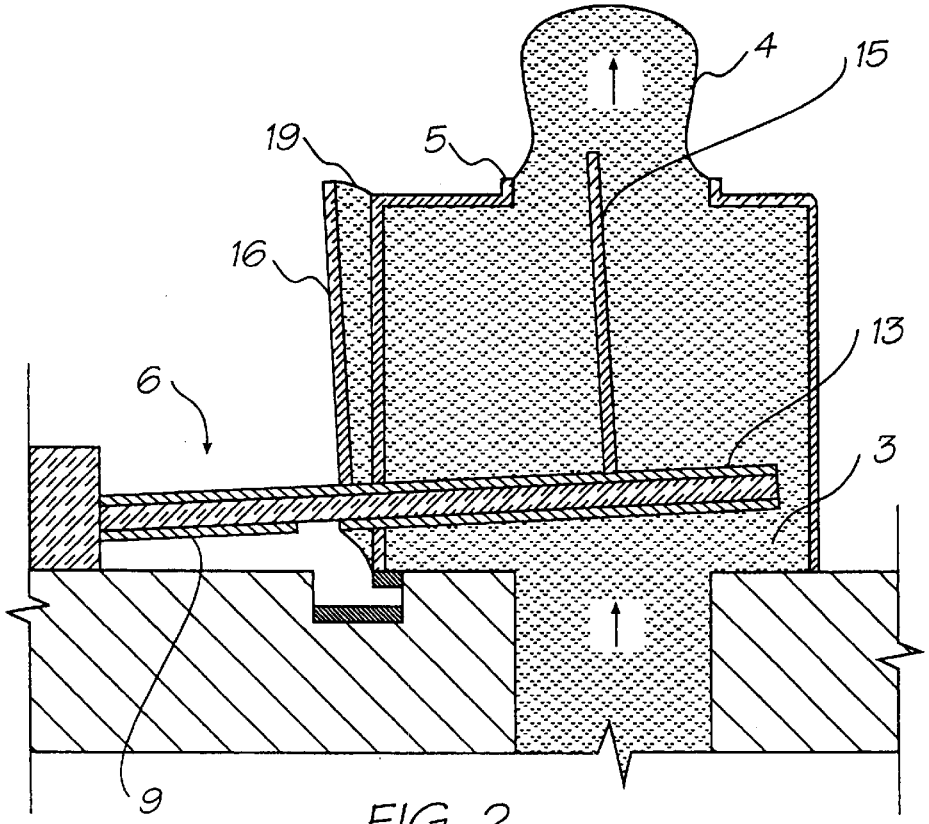
Figure 3:
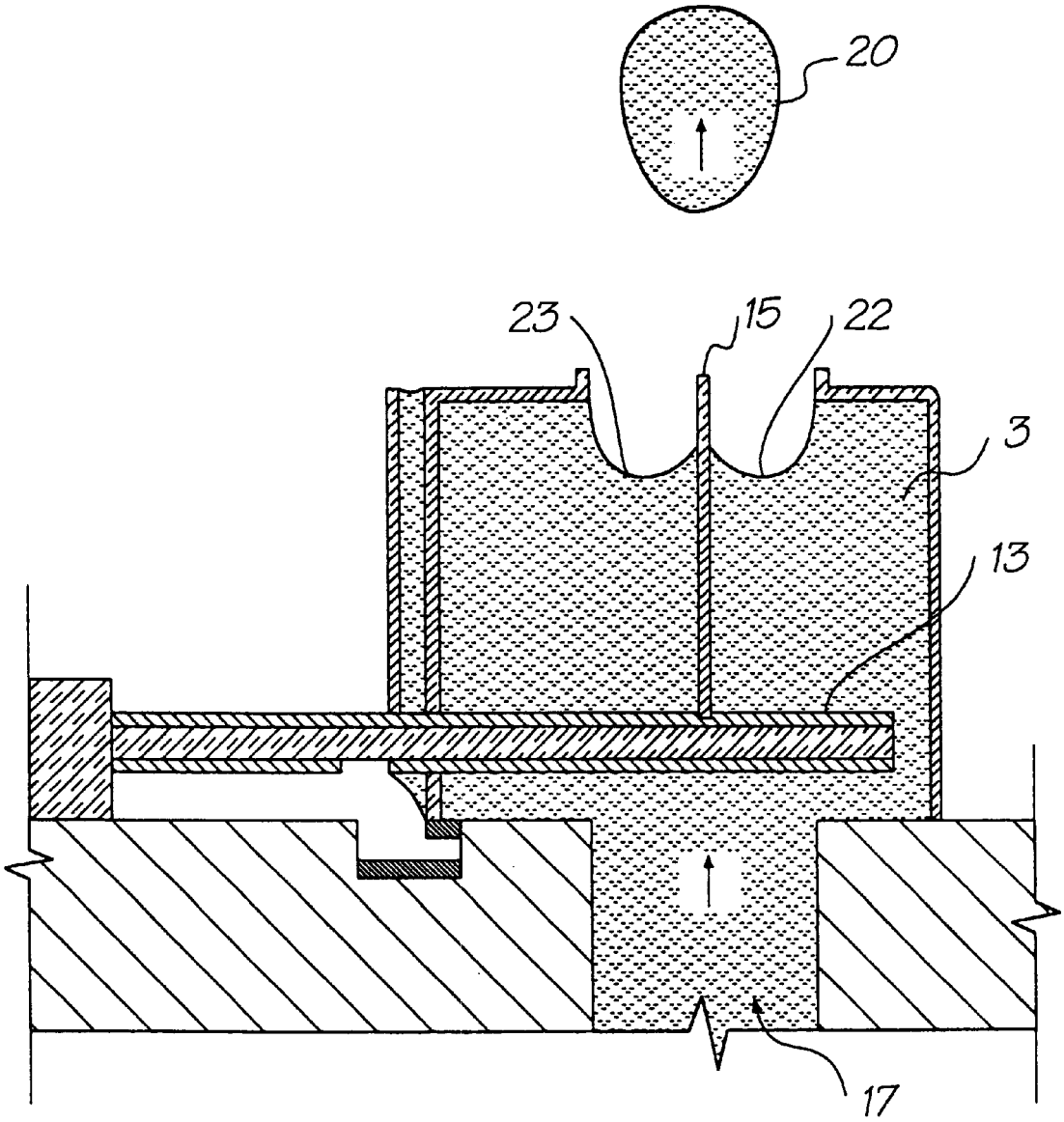

Turning now to FIG. 1 to FIG. 3 there will now be explained the operational principles of the preferred embodiment. In FIG. 1, there is illustrated a nozzle arrangement 1 which is formed on the substrate 2 which can comprise a semi-conductor substrate or the like. The arrangement 1 includes a nozzle chamber 3 which is normally filled with ink so as to form a meniscus 4 which surrounds a nozzle rim 5. A thermal bend actuator device 6 is attached to post 7 and includes a conductive heater portion 9 which is normally balanced with a corresponding layer 10 in thermal equilibrium. The actuator 6 passes through a slot in the wall 12 of the nozzle chamber and inside forms a nozzle ejection paddle 13. On the paddle 13 is formed a "poker" 15 which is formed when forming the walls of the nozzle chamber 3. Also formed on the actuator 6 is a actuator slot protection barrier 16. An ink supply channel 17 is also formed through the surface of the substrate 2 utilizing highly anisotropic etching of the substrate 2. During operation, ink flows out of the nozzle chamber 3 so as to form a layer 19 between the slot in the wall 12 and the actuator slot protection barrier 16. The protection barrier is profiled to substantially mate with the slot but to be slightly spaced apart therefrom so that any meniscus eg. 19 is of small dimensions.

Next, as illustrated in FIG. 2, when it is desired to eject a drop from the nozzle chamber 3, the bottom conductive thermal actuator 9 is heated electrically so as to undergo a rapid expansion which in turn results in the rapid upward movement of the paddle 13. The rapid upward movement of the paddle 13 results in ink flow out of the nozzle so as to form bulging ink meniscus 4. Importantly, the movement of the actuator 6 results in the poker 15 moving up through the plane of the nozzle rim so as to assist in the ejection of any debris which may be in the vicinity of the nozzle rim 5.

Further, the movement of the actuator 6 results in a slight movement of the actuator slot protection barrier 16 which maintains substantially the small dimensioned meniscus 19 thereby reducing the opportunity for ink wicking along surfaces. Subsequently, the conductive heater 9 is turned off and the actuator 6 begins to rapidly return to its original position. The forward momentum of the ink around meniscus 4 in addition to the backflow due to return movement of the actuator 6 results in a general necking and breaking of the meniscus 4 so as to form a drop.

The situation a short time later is as illustrated in FIG. 3 where a drop 20 proceeds to the print media and the meniscus collapses around poker 15 so as to form menisci 22, 23. The formation of the menisci 22, 23 result in a high surface tension pressure being exerted in the nozzle chamber 3 which results in ink being drawn into the nozzle chamber 3 via ink supply channel 17 so as to rapidly refill the nozzle chamber 3. The utilization of the poker 15 increases the speed of refill in addition to ensuring that no air bubble forms within the nozzle chamber 3 by means of the meniscus attaching to the surface of the nozzle paddle 13 and remaining there. The poker 15 ensures that the meniscus eg. 22, 23 will run along the poker 15 so as to refill in the nozzle chamber. Additionally, the area around the actuator slot barrier 16 remains substantially stable minimizing the opportunities for wicking therefrom.

Figure 4:
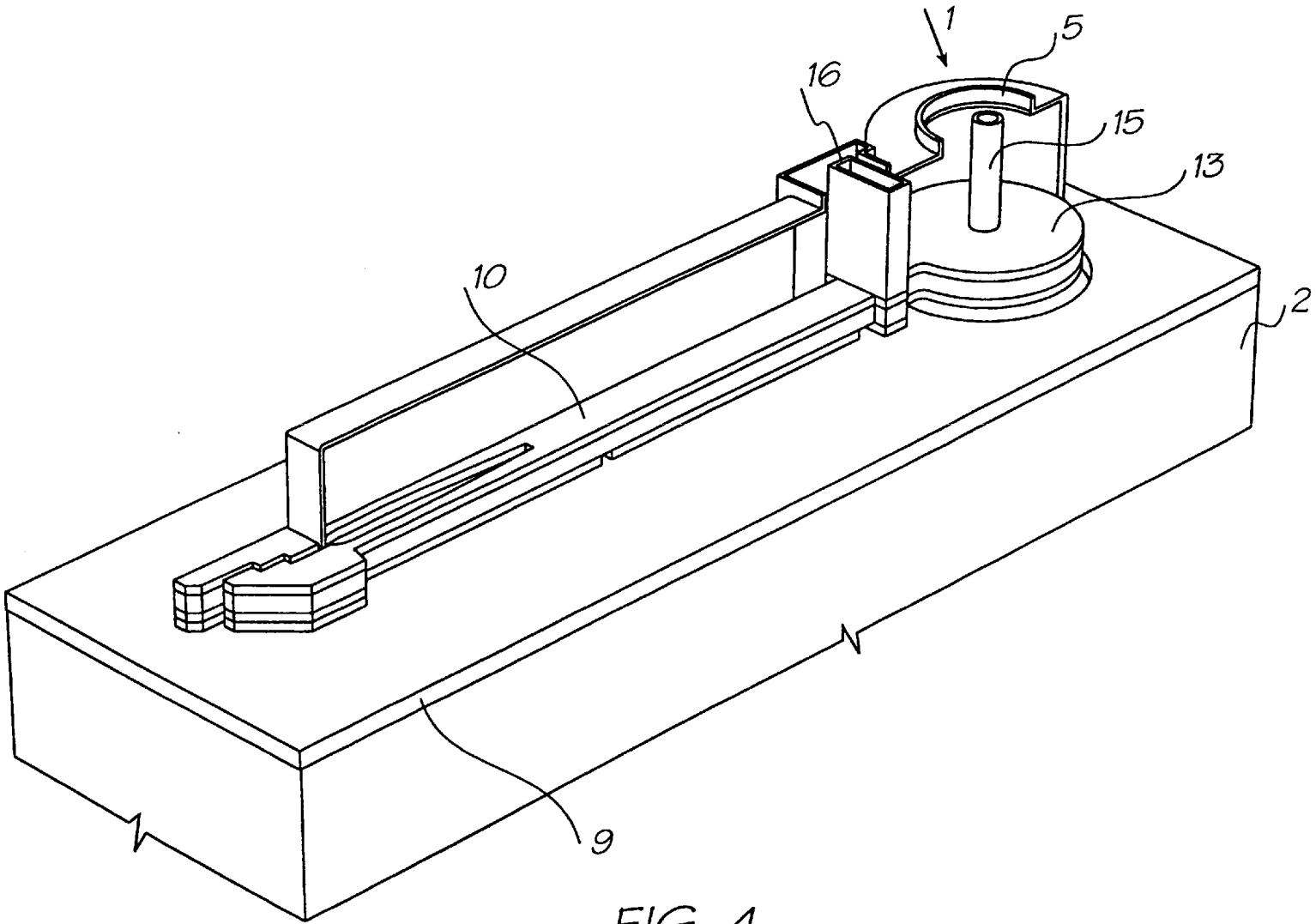
FIG. 4 is a side perspective view, partly in section, of a single nozzle arrangement of the preferred embodiment.
Figure 5:
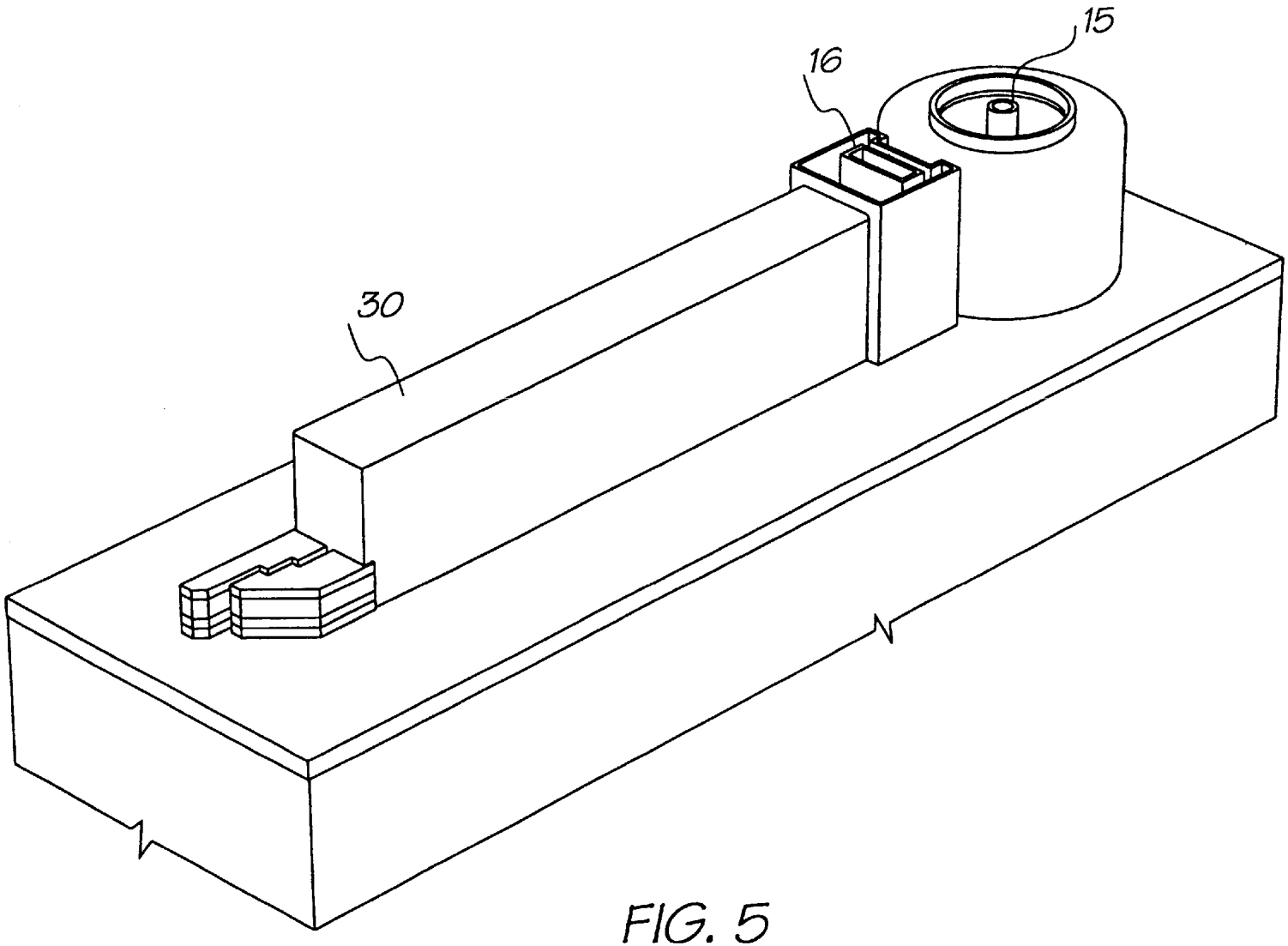
FIG. 5 illustrates a side perspective of a single nozzle including the shroud arrangement.
Figure 6:
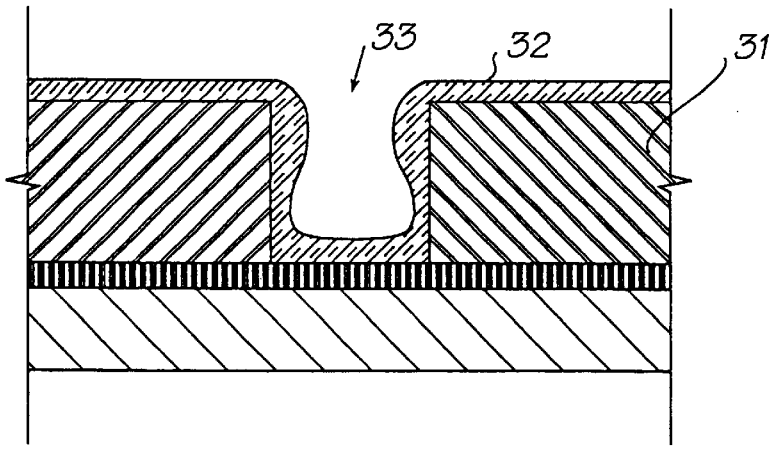
FIGS. 6 to 8 illustrates the principles of chemical, mechanical planarization utilized in the formation of the preferred embodiment.
Figure 7:
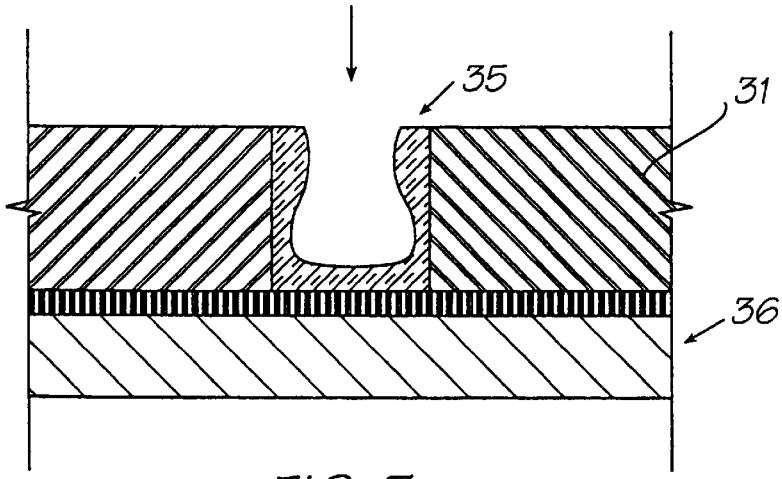
Figure 8:
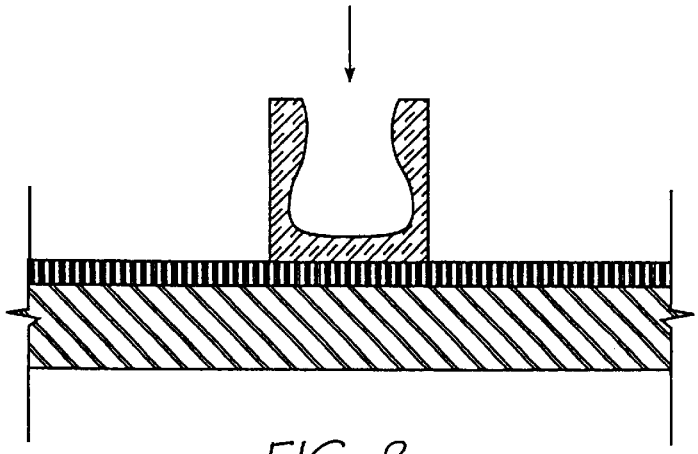

Turning now to FIG. 4 there is illustrated a side perspective view of a single nozzle arrangement 1 shown in sections. FIG. 5 illustrates a side perspective view of a single nozzle including a protective shroud 30. The central poker 15 and aperture card 16 are as previously discussed. The construction of the arrangement of FIGS. 4 and 5 can be as a result of the simple modification of deep mask steps utilized in the construction of the nozzle arrangement in Australian Provisional Patent Application PP6534 (the contents of which are specifically incorporated by cross-reference) so as to include the poker 15 and guard 16. The poker and guard are constructed primarily by means of a chemical mechanical planarization step which is illustrated schematically in FIG. 6 to FIG. 8. The poker 15 and guard 16 are constructed by depositing a surface layer 32 on a sacrificial layer 31 which includes a series of etched vias eg. 33. Subsequently, as illustrated in FIG. 7, the top layer is chemically and mechanically planarized off so as to leave the underlying structure 35 which is attached to lower structural layers 36. Subsequently, as illustrated in FIG. 8, the sacrificial layer 31 is etched away leaving the resulting structure as required.

It would be appreciated by a person skilled in the art that numerous variations and/or modifications may be made to the present invention as shown in the specific embodiment without departing from the spirit or scope of the invention as broadly described. The present embodiment is, therefore, to be considered in all respects to be illustrative and not restrictive.

I claim:

1. An inkjet printhead having a plurality of nozzle devices each comprising:

an ink chamber having an ink ejection aperture, a paddle situated within the chamber, an actuator connected to the paddle so as to move the paddle toward the aperture, a projection extending from the paddle and configured to extend through the aperture when the paddle is moved by the actuator toward the aperture to eject a drop of ink from the chamber through the aperture.

2. The printhead of claim 1 wherein the ink chamber of each nozzle device is supplied with ink via at least one conduit in an underlying substrate.

3. The printhead of claim 1 wherein the projection is an elongate poker member, a free end of which is positioned to protrude at least into the aperture when the paddle is moved by the actuator toward the aperture to eject a drop of ink from the chamber.

4. The printhead of claim 1 wherein the projection of each nozzle device is located concentrically with the aperture.

5. The inkjet printhead of claim 1 wherein the aperture is formed by MEMS process in which a series of layers are deposited and etched and the projection comprises a hollow cylindrical column.

6. The inkjet printhead of claim 5 wherein the hollow cylindrical column includes a proximal end at the paddle and a distal end adjacent the aperture, said distal end being chemically mechanically planarized during formation of the aperture.

7. The printhead of claim 1 wherein the actuator is a thermal bend actuator conductively heated so as to cause movement of said paddle.

8. The printhead of claim 1 wherein the projection is located substantially centrally on the paddle.

9. In an inkjet printhead having a plurality of nozzle devices, each including an ink chamber having an ink ejection aperture, a paddle situated within the chamber and an actuator connected to the paddle so as to move the paddle toward the aperture, a method of improving operational characteristics of the printhead comprising the step of:

locating a projection on the paddle configured to extend through the aperture when the paddle is moved by the actuator toward the aperture to eject a drop of ink from the chamber through the aperture.

* * * * *